US008269679B2

(12) United States Patent
Harrysson et al.

(10) Patent No.: US 8,269,679 B2
(45) Date of Patent: Sep. 18, 2012

(54) DISPLAY ARRANGEMENT WITH ENHANCED FUNCTIONALITY

(75) Inventors: Fredrik Harrysson, Göteborg (SE); Jonas Medbo, Uppsala (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 324 days.

(21) Appl. No.: 12/746,724

(22) PCT Filed: Dec. 6, 2007

(86) PCT No.: PCT/EP2007/063401

§ 371 (c)(1),
(2), (4) Date: Jun. 7, 2010

(87) PCT Pub. No.: WO2009/071125

PCT Pub. Date: Jun. 11, 2009

(65) Prior Publication Data

US 2010/0265417 A1 Oct. 21, 2010

(51) Int. Cl.
*H01Q 1/24* (2006.01)

(52) U.S. Cl. ..... 343/702

(58) Field of Classification Search ..... 343/702, 343/700 MS, 718, 730; 348/801; 455/280
See application file for complete search history.

(56) References Cited

U.S. PATENT DOCUMENTS

| | | | | |
|---|---|---|---|---|
| 5,410,749 | A * | 4/1995 | Siwiak et al. | 455/280 |
| 6,345,919 | B1 * | 2/2002 | Chapman | 396/428 |
| 7,480,502 | B2 * | 1/2009 | Biddulph | 455/416 |
| 7,589,685 | B2 * | 9/2009 | Ibi et al. | 343/721 |

* cited by examiner

*Primary Examiner* — Huedung Mancuso
(74) *Attorney, Agent, or Firm* — Roger S. Burleigh

(57) ABSTRACT

The present invention relates to a display arrangement comprising display means ($\mathbf{30}_4$) and receiving and/or transmitting means for radio waves, millimeter waves or microwaves. An electrically conductive structure (6A) is adapted to form said receiving and/or transmitting means. The display means (3O4) comprises an emission layer with a number of light emitting elements or pixel elements ($\mathbf{5}_{31}, \ldots, \mathbf{5}_{35}$). The electrically conductive structure (6A) is provided between said light emitting elements ($\mathbf{5}_{31}, \ldots, \mathbf{5}_{35}$) to form said receiving and/or transmitting means such that they are integrated with the display means (3O4). Light conducting means ($\mathbf{7}_{31}, \ldots, \mathbf{7}_{35}$) are provided to conduct light through the electrically conductive structure (6A) to represent imaging information on top of the display means.

21 Claims, 5 Drawing Sheets

DISPLAY ARRANGEMENT WITH ENHANCED FUNCTIONALITY

TECHNICAL FIELD

The present invention relates to a display arrangement comprising display means and receiving and/or transmitting means for radio-, millimeter- or microwaves.

Particularly it relates to a display arrangement with a receiving and/or transmitting capability for a wireless communication terminal.

BACKGROUND

Wireless communication terminals have to be equipped with a display screen as well as with receiving and/or transmitting means, more specifically antenna means. It is important that the display means are able to present optical information with a high resolution and a high quality. It is however also important that the receiving and transmitting capability is good. It is furthermore desirable to be able to provide a good coverage of all possible directions for the relevant radio communication channels. In communication networks it is also desirable to be able to provide a good data transmission capacity, both for single links and for the radio network as a whole. It is however difficult to fulfil these objects with known arrangements. Moreover, it should be possible to exploit the potential receiving/transmitting capacity as much as possible. Therefore a terminal unit may be equipped with multiple antennas which couple independently to the different degrees of freedom of the radio channel. For a single wave, the degrees of freedom are basically the direction and the polarization whereas in a real channel, a transmitted wave is scattered by physical objects in the surrounding environment resulting in a so called multipath channel. This means that there will be many different pathways corresponding to different directions, at the receiver as well as at the transmitter. To fulfil (also) these objects is even more difficult, or impossible with known arrangements. It is known to, for example on a laptop, use the frame surrounding a laptop display for an antenna means. However, the available space is then quite limited and it becomes difficult to take full advantage of the data transmission capacity as well as to handle real multipath channels. Furthermore, since the available space is limited, it is not possible to position antenna elements to an extent and with a variety as would be needed for many applications, particularly for advanced wireless communication systems or high speed wireless communication systems which require multiple antennas or antenna arrays. It is particularly difficult to provide sufficient coverage of all possible directions.

As an alternative to use the frame, it is known to use the backside of a laptop display for antenna placement. If the back of the screen of for example a laptop is used, the antenna elements will be screened by the display in the opposite direction. Since the radio paths having the best gain typically are concentrated within a limited angular range, if the back of the laptop is directed away from this angular range, the strongest paths will be heavily attenuated, which is a serious problem. This problem will be even more pronounced for future high speed wireless communication systems.

Thus, none of the suggested solutions is satisfactory for the reasons given above.

SUMMARY

It is therefore an object of the present invention to provide a display arrangement as initially referred to, or a combined display and receiving and/or transmitting arrangement, for radio-, millimeter or microwaves, which offers good optical representation capabilities at the same time as it offers an excellent receiving and/or transmitting capability. It is also an object of the invention to provide a combined display and receiving and/or transmitting arrangement wherein the display means and the receiving/transmitting means do not interfere such that either thereof negatively affects the performance, quality or efficiency of the other. Particularly it is an object to provide an arrangement wherein the receiving/transmitting means comprise antenna means and through which it is possible to efficiently cover all different directions of a multipath radio communication channel. Moreover it is an optional object to provide an arrangement through which a wireless communication device can be equipped with multiple antennas or antenna arrays coupling independently to different degrees of freedom of a multipath transmission/reception radio channel. Most particularly it is an object to provide an arrangement as referred to above through which it is possible to receive/transmit on the strongest paths. Even more particularly it is an object to provide an arrangement through which it is possible to provide a wireless communication device, for example for advanced wireless communication systems, which offers good receive/transmission capabilities and good optical representation capabilities without requiring a lot of space. It is also an object to provide a wireless communication device which has excellent radio-, millimeter wave receiving and transmitting capacity, which is flexible, easy to fabricate and wherein the available space can be utilized in a manner which is as effective as possible for receiving/transmitting and processing radio wave, millimeter wave or microwave signals.

Most particularly it is an object to provide a laptop (display) which has an excellent receiving/transmitting capacity/quality at the same time as an excellent optical presentation capability. It is also an object to provide a method for receiving/transmitting radio waves, millimeter waves or microwaves at the same time as providing presentation of optical information through which one or more the above mentioned objects can be achieved.

Therefore a display arrangement as initially referred to is provided which comprises an electrically conductive structure which is adapted or formed to provide said receiving and/or transmitting means and wherein the display means comprises an emission layer with a number of light emitting elements or pixel elements. The electrically conductive structure is provided between said light emitting elements to form said receiving and/or transmitting means, such that they will be integrated with the display means. Light conducting means are provided to conduct light through the electrically conductive structure to represent optical information on the display means. Optionally substantially all of the display surface or the display screen is used or available to be used also for receiving and/or transmitting means.

It is an advantage that substantially the whole display surface can be provided with a dual functionality without one of the functionalities being impaired or negatively affected by the other. It is particularly an advantage that a larger receiving and/or transmitting means, particularly an antenna means for example for a wireless communication device, can be provided wherein the antenna means have an excellent functionality in that it can be freely disposed over a large area and in that it is not screened by or dependent on the direction of the screen. It is also an advantage that a plurality of antenna elements or antenna arrays can be provided wherein the antenna elements can be located in any desired manner and that a high degree of freedom is provided for implementation of most effective antenna arrays for example for high speed wireless communication systems. It is also an advantage that the arrangement facilitates and enables a high data transmission capacity on single links as well as for a radio network. Another advantage is that a wireless communication terminal can be equipped with multiple antennas coupling independently to different degrees of freedom of a radio channel. Particularly it is an advantage that it becomes possible to locate and arrange antenna elements or arrays in a most efficient manner and of a desired number within the case of a multimedia device such that all possible directions of a radio channel can be covered. It becomes possible to utilize optionally the entire display surface for example of a laptop computer or similar both for radio (millimeter wave, microwave) communication as well as for optical presentation. It is also an advantage that transmission capacity can be boosted and that extraordinarily efficient and flexible antenna arrays with high gain and omnidirectional properties for beam-forming and spatial multiplexing can be provided in for example laptops or other wireless multimedia terminals.

BRIEF DESCRIPTION OF THE DRAWINGS

The invention will in the following be further described, in a non-limiting manner, and with reference to the accompanying drawings, in which.

DETAILED DESCRIPTION

Figure 1:
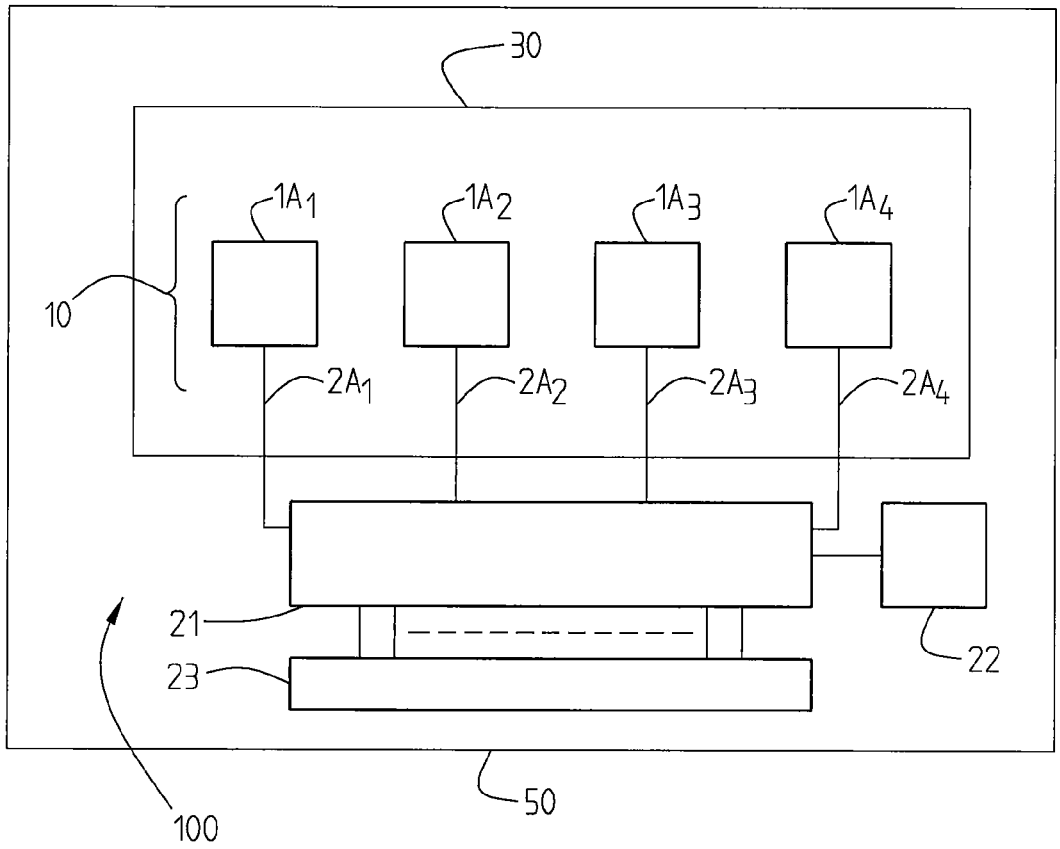
FIG. 1 is a block diagram of a first embodiment of a display and antenna arrangement.

FIG. 1 shows an implementation of an arrangement with receiving and/or transmitting means $\mathbf{1}A_1$, $\mathbf{1}A_2$, $\mathbf{1}A_3$, $\mathbf{1}A_4$ adapted to form an antenna means 10 with receiving and/or transmitting elements comprising antenna elements. The number of antenna elements $\mathbf{1}A_1$, $\mathbf{1}A_2$, $\mathbf{1}A_3$, $\mathbf{1}A_4$ is of course not limited to the explicitly illustrated number of elements. They can also be arranged in different ways, as one or more arrays and they may particularly comprise patches of any appropriate shape and size.

It should however be clear that the antenna elements do not have to be patches, but the inventive concept is applicable to substantially any type of antenna elements, for example dipoles, coplanar antennas etc. According to the invention the antenna means 10 are integrated with the display 30 which for example may serve as a laptop screen 50. The respective antenna elements are connected by means of conducting lines $\mathbf{2}A_1$, $\mathbf{2}A_2$, $\mathbf{2}A_3$, $\mathbf{2}A_4$ with feeding, switching and/or combining means 21, e.g. RF switching and combining circuits controlled by controlling means 22 comprising a digital switching and combining control means. Feeding is here supposed to be provided by said switching and/or combining means 21, but alternatively feeding is provided by separate means. Each antenna element can be fed separately. The switching and/or combining means 21 provides for connection, over antenna element ports, to a so called RF radio chain. A RF/RX (receiving) chain here means the electronics used for example for down conversion to intermediate frequencies, filtering, signal detection, separation from TX (transmission) signals, analogue to digital (A/D) conversion etc. A RF/TX chain is used when elements act as transmitting elements.

Since the antenna elements are integrated with the display means, substantially the entire display screen surface of for example a laptop or some other wireless communication device is available and can be used also for receiving/transmission (RX/TX) of radio waves. In other words the entire display surface is available for provisioning of antenna elements in any desired configuration, of any desired number and the antenna elements are not screened by the display and the display (pixel elements) is not screened by the antenna means.

Figure 2:
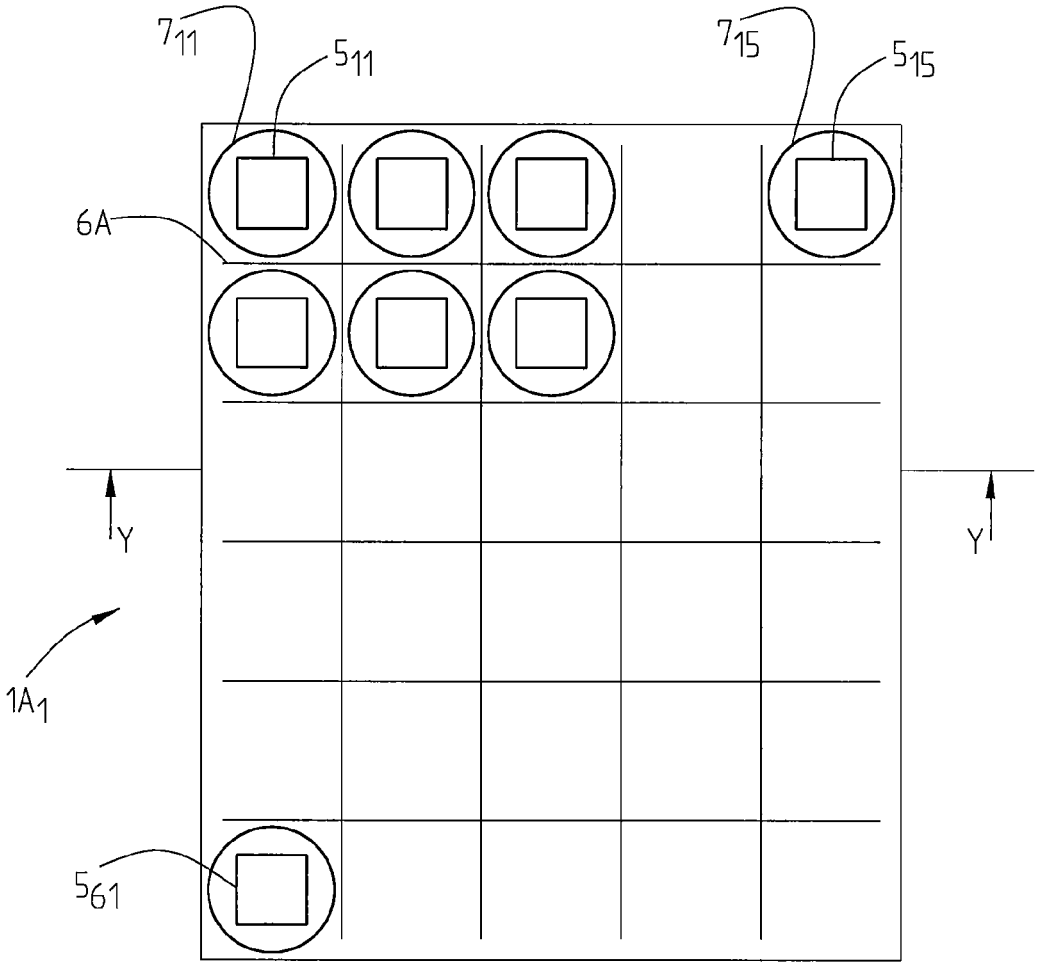
FIG. 2 is an enlarged view of an antenna element as in FIG. 1.

FIG. 2 is a simplified enlarged top view of an antenna element $\mathbf{1}A_1$ which is integrated with the display, i.e. a portion of the display. Antenna element $\mathbf{1}A_1$ here is a rectangular patch (that the patches are illustrated as square shaped in FIG. 1, merely intends to show that the patches can have any appropriate shape). The relevant part of the display 30 on which the antenna element $\mathbf{1}A_1$ is provided comprises a plurality of light emitting elements or pixel elements $\mathbf{5}_{11}, \ldots, \mathbf{5}_{65}$. The conducting mesh or grid of for example thin metal wires $\mathbf{6}_A$, which are interconnected, is arranged in the spaces between the small pixel element, for example LED pixels, in the upper layer of the LED display. The mesh or grid $\mathbf{6}_A$ is structured to build up an electrically conductive antenna structure in the top layer not covering or screening the pixel elements or disturbing the optical representation capability of the pixel elements. Thus, the conducting grid $\mathbf{6}_A$ is located in between the pixel elements to provide predetermined antenna elements, here a patch, but it may also be other types of antenna elements, with a size and shape chosen in the appropriate manner for e.g. wireless communication frequencies such as within WLANs (Wireless Local Area Networks) or other communication networks.

In order to support the transfer of light from each pixel element $\mathbf{5}_{11}, \ldots, \mathbf{5}_{65}$ through the antenna conducting mesh layer, short, for example conical, optical wave guides or fiber segments $\mathbf{7}_{11}, \ldots, \mathbf{7}_{65}$ are provided to conduct light from the respective pixel elements. This means that the antenna layer (the conducting structure $\mathbf{6}_A$) will be transparent to light and not affect the optical presentation capability. The conductive structure opens up the possibility to place antennas and antenna arrays in any desired manner throughout the surface occupied by the display screen. It is also plausible that with an arrangement as described, using wave guides, the optical representation capability can, if not increased, at least be kept at the same level as if there were no integrated antenna meaning that there will be no negative impact through the integration of the antenna structure. It becomes possible to select the placement, the number of and the characteristics of antenna elements, particularly their directional properties (directional, multidirectional, omnidirectional) in a very effective manner within the case of for example a multimedia communication device, which is extremely advantageous.

Figure 3:
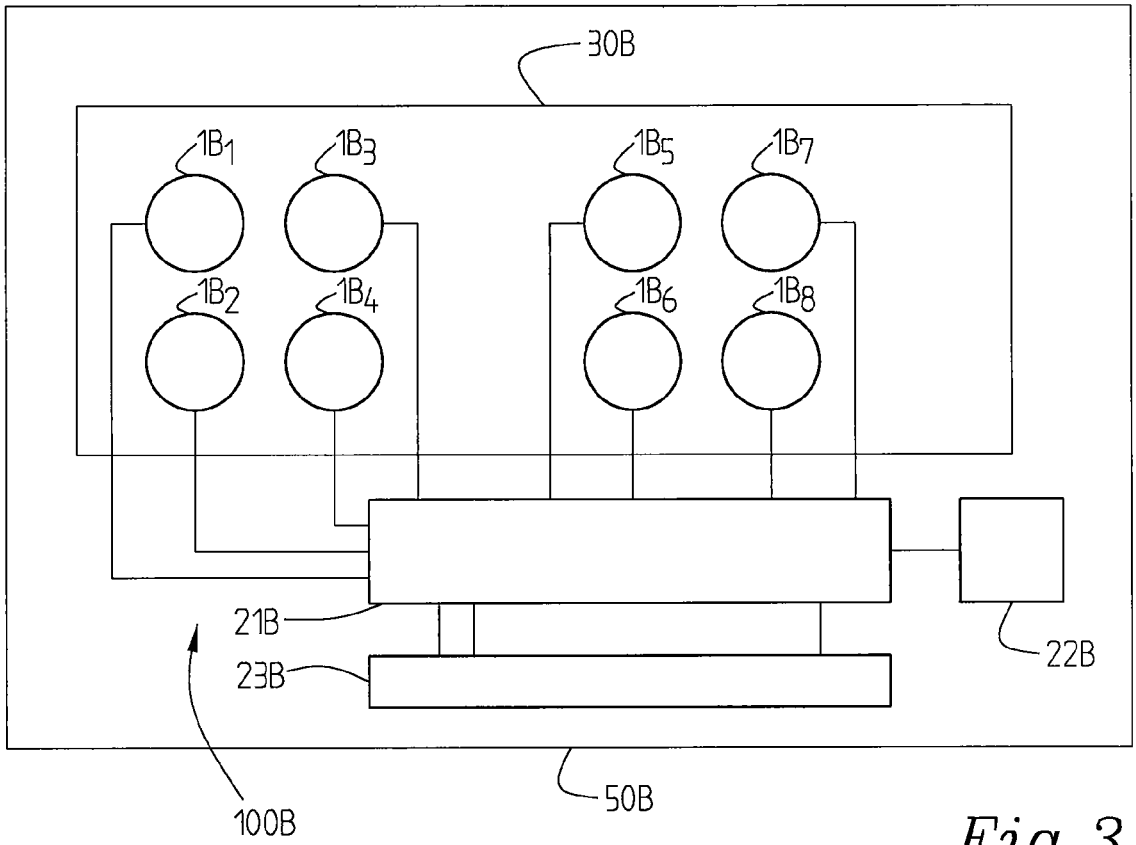
FIG. 3 is a schematical block diagram of a second embodiment of a display and antenna arrangement.

FIG. 3 schematically shows another implementation of an arrangement of antenna elements $\mathbf{1}B_1, \ldots, \mathbf{1}B_8$ integrated with a display means 30B. The antenna elements comprise circular patches which as in FIG. 1, are connected to feeding, switching and/or multiplexing means 21B connected to (or comprising) digital control means 22B. Antenna ports are connected to for example an RF chain 23B. In this embodiment the antenna elements are arranged in two arrays comprising antenna elements $1B_1$-$1B_4$ and $1B_5$-$1B_8$ respectively.

Figure 4:
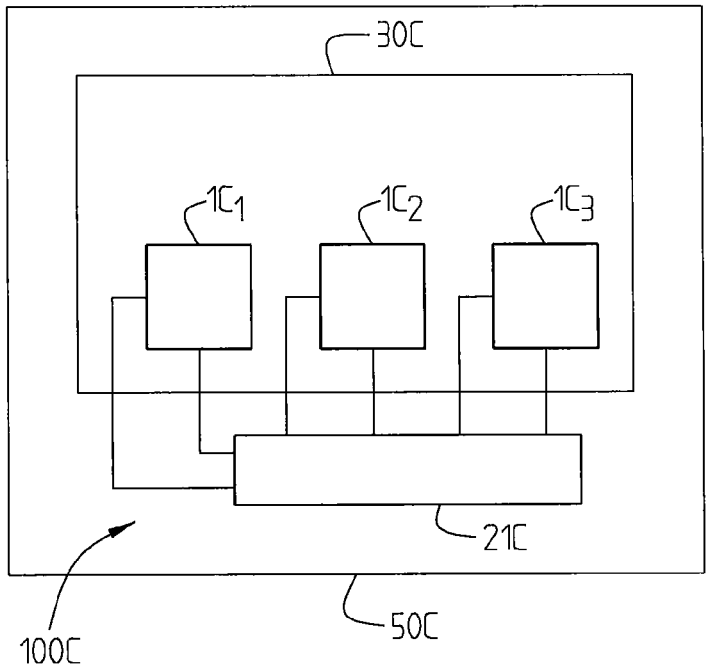
FIG. 4 is a schematical block diagram of a third embodiment of a display and antenna arrangement.

FIG. 4 shows still another example of a display and antenna arrangement 100C wherein square-shaped antenna elements $1C_1$, $1C_2$, $1C_3$, $1C_4$ are integrated with a display means 30C. In this case the antenna elements support dual polarizations and two connection links connect each antenna element to the feeding switching and/or multiplexing means 21C, which here are supposed to incorporate also the digital control means. Of course also for dual polarization antenna elements separate digital control means can be provided as shown e.g. in FIG. 1. The RF RX/TX chain functionality, or parts of it, is optionally incorporated in extended switching and/or combining means 21C but preferably it is provided externally thereof.

The enlarged view of FIG. 2 showing the conducting grid structure between pixel elements is, with a plurality of possible modifications concerning size, shape, type etc. of antenna elements and pixel elements, applicable to any embodiment since it shows a basic principle of the present inventive concept.

Figure 5:
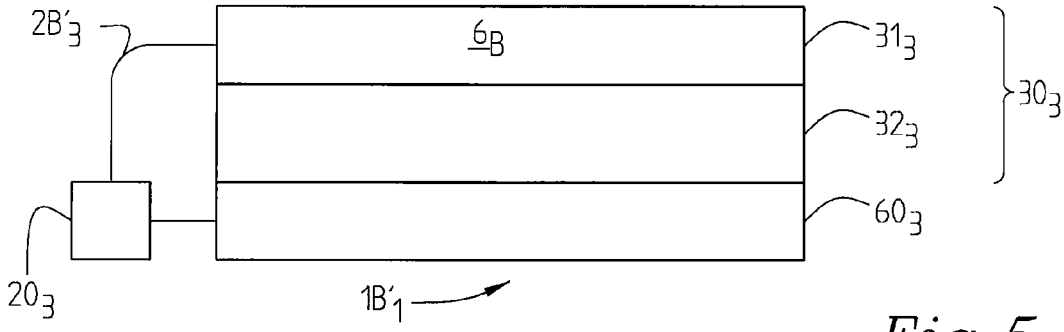
FIG. 5 is a cross-sectional view of a display arrangement with receiving/transmitting elements.

FIG. 5 is a schematical cross-section of an antenna element wherein a conductive grid structure 6B is integrated within display means $30_3$, in the upper display layer $31_3$ provided on the pixel element layer $32_3$. The arrow denoted top/front indicates that the electrically conductive grid structure is provided in the top or at the front of the display means. Generally the display means $30_3$ inherently incorporates a conductive layer or a ground layer which may be used as a ground plane also for the conductive structure (not shown) if it requires a ground plane functionality, such as for patches as opposed to for dipole antennas or coplanar antennas. In this embodiment, however, a separate ground plane is provided below the display $60_3$ to act as a ground plane for the electrical conductive grid structure forming the patch antenna $1B_1'$. By means of a transmission wire or a conducting wire $2B_3'$, the conductive grid structure $6_B$ is connected to an RF connector $20_3$.

Generally, if the grounding functionality of the display means is used also for the antenna means, depends on the actual display technology that is used (and if the antenna means require a ground plane).

Optionally the feeding means as referred to above, which are connected to and provided for feeding the antenna elements, are adapted to feed said antenna elements separately or groupwise.

Optionally the feeding, switching and/or combining means are integrated in a circuit board of the display means. The display means may for example be the display means of a wireless communication device, particularly a wireless multimedia communication device such as a laptop, palmtop, mobile telephone or similar. The switching and/or combining means are optionally provided in the circuit board of the wireless communication device, either in the display part or in the computer control means of the display.

The transmitting and/or receiving elements may be elements performing one of the receiving and transmitting functionalities or they may be transmitting and receiving elements, normally antenna elements. They may be combined in arrays. A combined display and sensor arrangement normally only needs elements supporting the receiving functionality.

Figure 6:
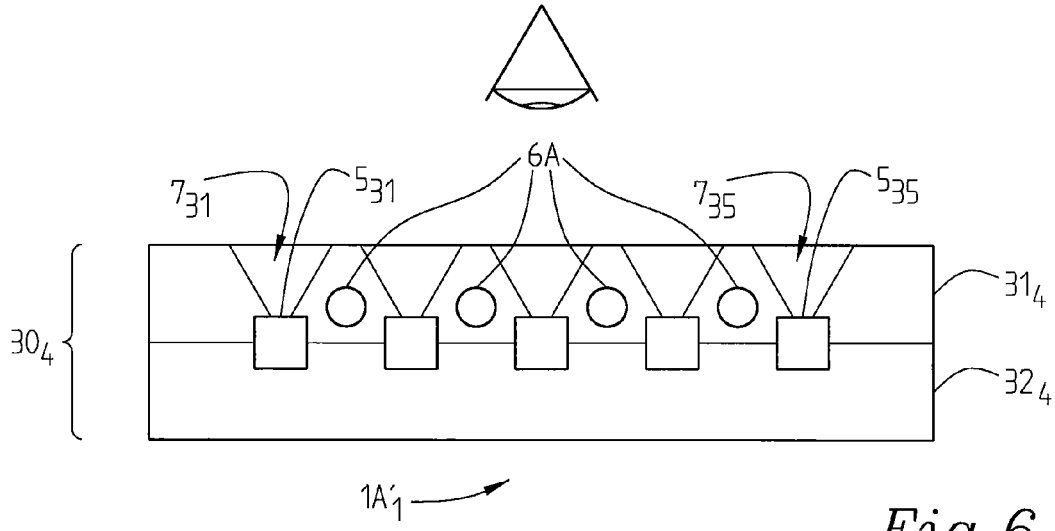
FIG. 6 is a cross-sectional view of a part of a display with a receiving/transmitting element, FIG. 7 very schematically illustrates a laptop with a display and antenna arrangement according to the present invention.

FIG. 6 is a view in cross-section taken through for example antenna element $1A_1$ (Y-Y) wherein the pixel elements $5_{31}$, $5_{35}$ are provided in a display or a pixel layer $32_4$ which may comprise a semiconducting layer with or without a metal bottom layer and an upper display layer $31_4$ of the display means $30_4$ for example comprising a glass or plastic (dielectric) material. The conductive structure 6A disposed in the upper display layer $31_4$ is shown in cross-section. In this embodiment one conductor is disposed between each pixel element. In other conductive structures there may be one conductor between every second, every third pixel element in a row and/or column etc. The conductors may also be arranged in an irregular manner with respect to the pixel elements. The light from each pixel element $5_{31}, \ldots, 5_{35}$ is transmitted through the upper display layer (also forming the antenna patch layer) by means of conical optical wave guides $7_{31}, \ldots, 7_{35}$. Through the use of the optical wave guides, e.g. optical fibers, it is possible to use particularly small light sources. The optical wave guides can be of different kinds and forms and e.g. act to or be shaped as lenses or comprise lenses. Alternatively they may be connected to lenses.

Thus, according to the present invention multiple antennas or antenna arrays can be used for diversity, beam-forming gain or spatial multiplexing (MIMO; Multiple Input Multiple Output) as provided for through the switching and/or combining means as discussed above. Since it becomes possible to freely select location, shape, type and the way in which antenna elements or arrays are arranged, for example in the case of a multimedia or wireless communication device, it becomes possible to provide coverage for all possible/relevant directions; antenna elements may be directional, multidirectional or even omnidirectional.

It accordingly becomes possible to provide antenna arrangements suitable for beam-forming, fixed or adaptive depending on application, providing improved antenna gain and interference suppression capabilities as compared to antenna arrays which have to be placed outside the display screen on for example a laptop computer.

Figure 7:
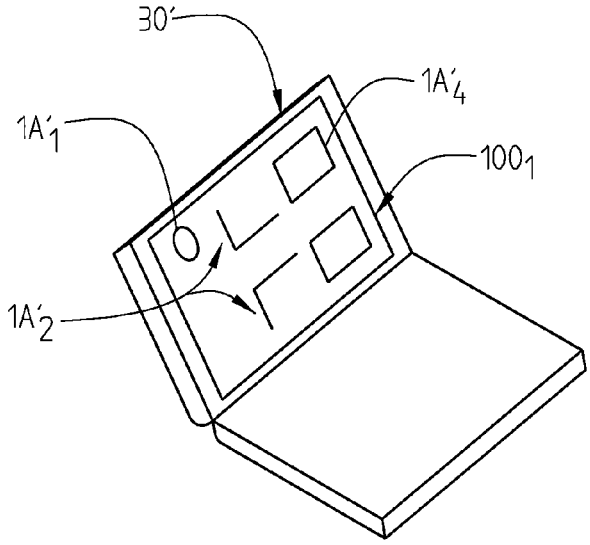

FIG. 7 very schematically illustrates an embodiment with a combined display and antenna arrangement $100_1$ provided by means of the display screen 30' of a laptop. Antenna elements $1A_1'$, $1A_2'$, $1A_4'$, for example formed as patches or dipoles or coplanar antenna elements are integrated with the display circuits. The antenna elements are formed by means of an integrated electrically conductive grid structure which can be realized in many different ways; by means of a semiconducting structure, arranged to form patches etc. It may be arranged to form several separate antenna elements or arrays (array antennas). In addition to the antenna elements, a feeding structure (not shown here) comprising transmission lines may be formed either by coaxial cables, thin wires, thin wave guides, for example strip-line or microstrip, and also be fitted into the structure. It incorporates or is associated with feeding, switching and/or combining means (not shown in FIG. 7).

The inventive concept is applicable particularly with LED displays. The concept may however also be implemented with other types of displays as long as it is practically possible to arrange conductors between light element (or e.g. transistors or devices controlling light elements or light sources).

Figure 8:
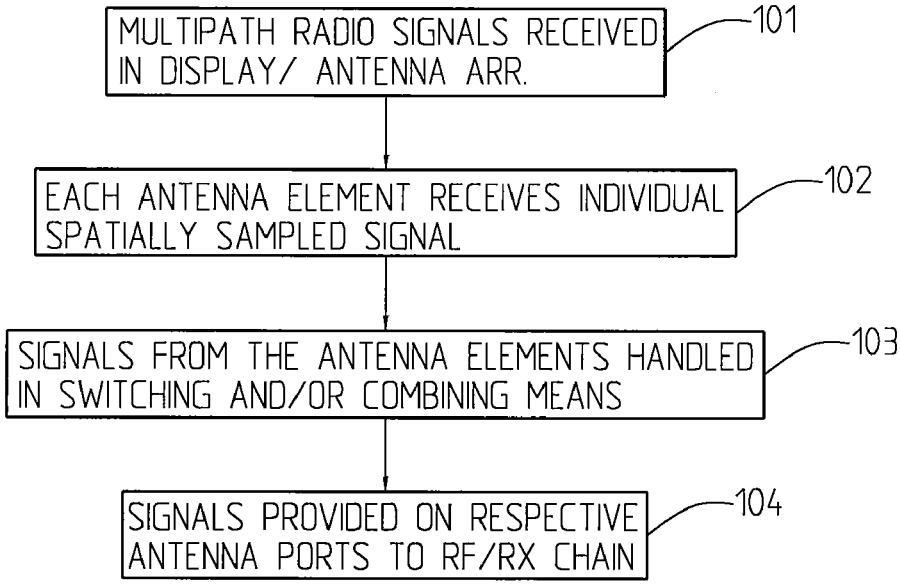
FIG. 8 is a schematical flow diagram describing one implementation of the inventive concept at reception of radio signals.

FIG. 8 is a very schematical flow diagram describing reception of multipath radio signals in a combined or integrated display and antenna arrangement, 101. The antenna elements are arranged in any desired manner throughout the display, and receives individual, spatially sampled signals, 102 which means that they are received at different locations (and/or with different polarizations) in the regularly or irregularly, in any desired manner, arranged antenna elements, 102. The respective signals from the antenna elements, formed by the conductive structure arranged between the light elements, are then handled in switching and/or combining means, 103, for example comprised in a distribution network normally controlled by digital control circuits. The switching and/or combining network is adapted to provide spatially filtered or beam-formed signals or spatially multiplexed multiple stream signals or signals with excellent diversity. The signals are then provided to an RF RX chain of the concerned radio network (or a wireless communication network using millimeter waves or microwaves) in which the signal is down converted, filtered, mixed, a signal detection is performed for separating receive signals from transmit signals etc. In general the signals can be processed in many different ways which is made possible mainly through the great flexibility as far as placement and arrangement of antenna elements is concerned. For receive signals an A/D (analogue to digital) conversion takes place in the RF chain.

Figure 9:
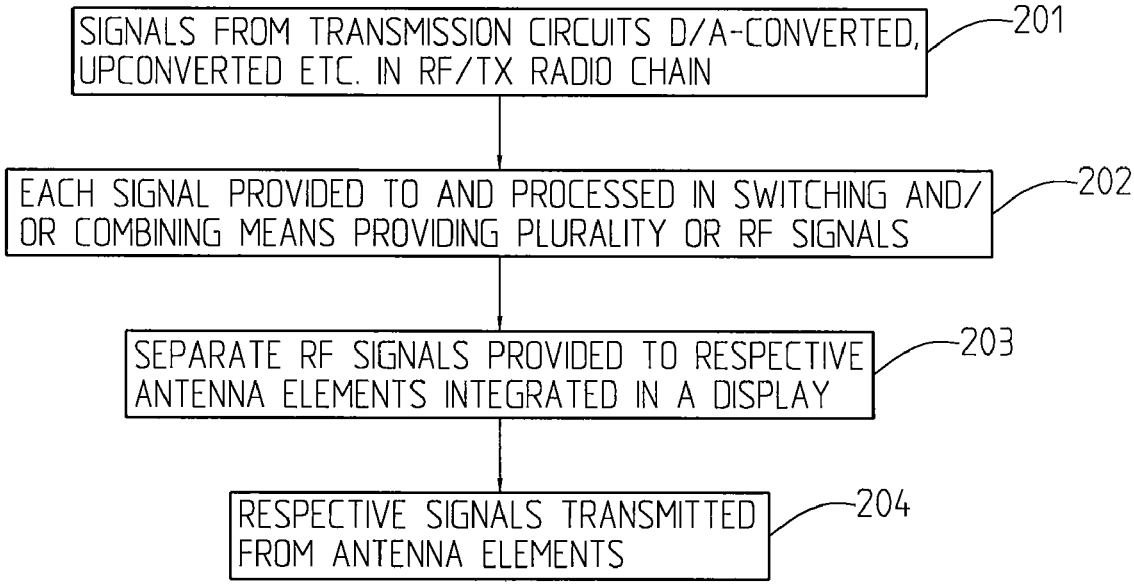
FIG. 9 is a schematical flow diagram describing one way of transmitting radio wave signals with an arrangement according to one embodiment.

FIG. 9 is a schematical flow diagram describing the transmitting functionality. Signals from transmission circuits are D/A-converted, up-converted etc. in an RF TX radio chain, 201. Thereafter each respective signal is provided to and processed in switching and/or combining means providing a plurality of RF-signals, with diversity and/or beam-formed, multiplexed etc. in any desired manner 202. The separate RF-signals are provided to respective antenna elements integrated with a display, 203. The respective signals are then transmitted from the antenna elements, 204. The receiving and transmission functionality described in the flow diagrams of FIGS. 8 and 9 take place simultaneously with optical representation of images through the pixel elements via the optical waveguides such that the receiving/transmitting functionality does not impair, and is not impaired by, the optical representation functionality.

The density of integrated circuits that can be arranged on a substrate increases rapidly with time (Moore's law). If this also is applicable for the pixels in a LED screen, the pixel density or resolution will continue to increase with time as well, i.e. the minimum pixel size will decrease. A high pixel density is required for good resolution of the screen picture. However, the maximum necessary density is related to the resolution that can be utilized by the human eye. Beyond this point, increased miniaturization of components will not increase the visual performance.

It should be clear that the invention can be varied in a number of ways, without departing from the scope of the appended claims. It can also be implemented in other than wireless communication unit devices, the main thing being that RX/TX means are integrated in the surface of an optical representation means, where the type, location, shape, number of antenna elements is given by how the conducting structure is provided between the light elements. Also in other aspects the inventive concept is not limited to the specifically illustrated embodiments, neither as far as the form, shape, number, arrangement, localization and type of antenna elements is concerned, nor as far as used display technology is concerned. The arrangement may also include more or less signal processing functionalities of different kinds.

The invention claimed is:

1. A display arrangement comprising display means and receiving and/or transmitting means for radio waves, millimeter waves or microwaves, wherein an electrically conductive structure is adapted to form said receiving and/or transmitting means, that the display means comprises an emission layer with a number of light emitting elements or pixel elements, that the electrically conductive structure is provided between said light emitting elements to form said receiving and/or transmitting means, such that they are integrated with the display means, and in that light conducting means are provided to conduct light through the electrically conductive structure to represent imaging information on top of the display means.

2. A display arrangement according to claim 1, wherein the light conducting means comprise optical waveguides or optical fibres adapted to allow light to pass through the electrically conductive structure from each of said pixel elements.

3. A display arrangement according to claim 1, wherein the electrically conductive structure comprises a mesh or grid of interconnected thin metal wires.

4. A display arrangement according to claim 1, wherein, the electrically conductive structure is adapted to form an antenna arrangement with a number of receiving and/or transmitting elements comprising antenna elements.

5. A display arrangement according to claim 4, wherein the sizes and/or the shapes of the antenna elements are adapted to depend on the frequency and/or polarization properties of a communication channel for said radio-, millimeter- or microwaves.

6. A display arrangement according to claim 4, wherein feeding means are provided which are connected, directly or indirectly, to the antenna elements, for feeding of the said antenna elements, separately or groupwise.

7. A display arrangement according to claim 1, wherein the receiving and/or transmitting elements, or antenna elements, are arranged to form an array or a number of sub-arrays.

8. A display arrangement according to claim 4, wherein the antenna elements separately, over separate transmission means are connected to feeding, switching and/or combining means comprising or being connected to digital control means and, via antenna ports, to radio- or millimeter wave or microwave TX/RX communication processing means.

9. A display arrangement according to claim 6, wherein the feeding, switching and/or combining means comprise or are connected to beam-forming means or MIMO spatial multiplexing means.

10. A display arrangement according to claim 4, wherein the antenna elements comprise antenna patches.

11. A display arrangement according to claim 10, wherein the display means comprises a grounding conductive layer and in that said grounding conductive layer is adapted to act as a ground plane for the receiving and/or transmitting elements.

12. A display arrangement according to claim 10, wherein a separate grounding conductive layer is provided which is adapted to act as a ground plane for the electrically conductive structure and in that the receiving and/or transmitting elements are antenna patches.

13. A display arrangement according to claim 1, wherein the receiving and/or transmitting elements comprise antenna elements and in that said antenna elements comprise dipole antenna elements or coplanar antenna elements.

14. A display arrangement according to claim 1, wherein the receiving and/or transmitting elements separately or groupwise are connected to feeding and control means for feeding and controlling the receiving and/or transmitting elements.

15. A display arrangement according to claim 1, wherein the display means comprises an LED with a plurality of LED pixel elements or an OLED display or similar.

16. A display arrangement according to claim 1, wherein the receiving and/or transmitting elements are arranged to extend throughout substantially the entire surface of the display means.

17. A display arrangement according to claim 4, wherein it is adapted to be arranged as display screen of a wireless communication device, e.g. a laptop, a palmtop or a mobile phone or similar and to act as a combined display and antenna arrangement.

18. A display arrangement according to claim 17, wherein the feeding, switching and/or combining means are integrated in a circuit board of the display means of the wireless communication device, either in the display or in computer control means thereof.

19. A display arrangement according to claim 1, wherein the electrically conductive structure is adapted to form receiving elements and in that the display arrangement is adapted to act as a combined display and sensor arrangement.

20. A method of receiving and handling radio- or millimeter- or microwave signals in an arrangement comprising a display means and receiving means, comprising the steps of:

receiving radio- or millimeter- or microwave signals in respective receiving elements, e.g. antenna elements, provided by means of an electrically conductive structure integrated between light emitting elements or pixel elements which are associated with light conducting means, said light conducting means conducting light through the electrically conductive structure, combining and/or switching and/or multiplexing the received, separate signals in combining and/or switching and/or multiplexing means connected to the receiving elements and associated with the display means such that at least a major surface portion of the display screen, e.g. on a laptop or similar, can be used both for optical presentation and for radio-, millimeter- or microwave reception, the receiving or antenna elements being fed separately or groupwise.

21. A method of handling and transmitting radio or millimeter wave signals in an arrangement comprising a display means and a transmitting or a receiving and transmitting means, comprising the steps of:

switching and/or combining and/or multiplexing a number of radio- or millimeter- and/or microwave signals in a combining and/or switching, or distribution, network associated with or in a display means, providing separate radio- or millimeter- or microwave signals to transmitting elements provided by means of an electrically conductive structure integrated between light emitting elements or pixel elements which are associated with light conducting means for conducting light through the transmitting elements of the electrically conductive structure such that at least a major surface portion of a display screen, e.g. on a laptop or similar, can be used both for optical presentation and for radio-, millimeter- or microwave transmission.

* * * * *

UNITED STATES PATENT AND TRADEMARK OFFICE

CERTIFICATE OF CORRECTION

PATENT NO. : 8,269,679 B2
APPLICATION NO. : 12/746724
DATED : September 18, 2012
INVENTOR(S) : Harrysson et al.

It is certified that error appears in the above-identified patent and that said Letters Patent is hereby corrected as shown below:

On the Title Page:

Item (57), under "ABSTRACT", in Column 2, Line 6, delete "(3O4)"
and insert -- ($30_4$) --, therefor.

Item (57), under "ABSTRACT", in Column 2, Line 11, delete "(3O4)."
and insert -- ($30_4$). --, therefor.

Signed and Sealed this
Twentieth Day of November, 2012

David J. Kappos

David J. Kappos
*Director of the United States Patent and Trademark Office*